US008522398B2

(12) United States Patent
Haab et al.

(10) Patent No.: US 8,522,398 B2
(45) Date of Patent: Sep. 3, 2013

(54) CARRIAGE FOR HOLDING A SEPARATION ELEMENT AND SEPARATION ELEMENT

(75) Inventors: Gregor Haab, Allenwinden (CH); Martin Frei, Ottenbach (CH); Alfred Stutz, Hausen a.A. (CH)

(73) Assignee: Hawa AG, Mettmenstetten (CH)

( * ) Notice: Subject to any disclaimer, the term of this patent is extended or adjusted under 35 U.S.C. 154(b) by 543 days.

(21) Appl. No.: 12/662,688

(22) Filed: Apr. 28, 2010

(65) Prior Publication Data

US 2010/0269291 A1 Oct. 28, 2010

(30) Foreign Application Priority Data

Apr. 28, 2009 (EP) ..... 09158984

(51) Int. Cl.
*E05D 15/16* (2006.01)

(52) U.S. Cl.
USPC ..... 16/105; 16/91; 16/102

(58) Field of Classification Search
USPC ..... 16/87 R, 87.2, 95 D, 96 D, 87.6 R, 16/97, 98, 99, 100, 91, 102, 105, 106, 107; 49/425, 409; 160/196.1, 199, 206
See application file for complete search history.

(56) References Cited

U.S. PATENT DOCUMENTS

| | | | | |
|---|---|---|---|---|
| 524,609 | A * | 8/1894 | Prouty | 16/105 |
| 956,025 | A * | 4/1910 | Ballard | 16/105 |
| 5,018,306 | A * | 5/1991 | Prevot | 49/425 |
| 5,149,180 | A | 9/1992 | Haab et al. | |
| 5,791,089 | A * | 8/1998 | Prevot et al. | 49/425 |
| 5,860,189 | A * | 1/1999 | An | 16/91 |
| 6,021,547 | A * | 2/2000 | Stagoll | 16/105 |
| 6,052,867 | A | 4/2000 | Haab et al. | |
| 6,418,588 | B1 | 7/2002 | Haab et al. | |
| 7,712,258 | B2 * | 5/2010 | Ewing et al. | 49/410 |
| 2005/0011041 | A1 * | 1/2005 | Ness | 16/105 |
| 2006/0230684 | A1 * | 10/2006 | Poole | 49/409 |

FOREIGN PATENT DOCUMENTS

| | | |
|---|---|---|
| CA | 1040933 | 10/1978 |
| CN | 101063392 A | 10/2007 |
| EP | 1 460 225 A1 | 9/2004 |
| KR | A-2002-0011199 | 2/2002 |

OTHER PUBLICATIONS

Examination Report on New Zealand Patent Application No. 584905, mailed on May 4, 2010.

* cited by examiner

*Primary Examiner* — Jeffrey O'Brien
(74) *Attorney, Agent, or Firm* — Oliff & Berridge, PLC

(57) ABSTRACT

The carriage, which serves for holding a slidable separation element, comprises a carriage body and at least one running wheel, which is a rolling along a rail when the separation elements is displaced. According to the invention the carriage body comprises a housing with an interior space, in which a holding unit is provided, which is protruding through an opening out of the housing and which is seated slidable in a direction at least approximately vertically to the running direction of the carriage, and which the holding unit comprises a holding element that interacts within the housing with an adjusting element, that is displaceable in relation to the holding element by means of an adjusting screw, which is held by the carriage body, so that the holding unit is held at a selected position, whereas either the part of the holding unit that is protruding out of the housing is provided with the at least one running wheel and the carriage body is connected to the separation element; or the part of the holding unit that is protruding out of the housing is connected to the separation element and the carriage body is provided with the at least one running wheel.

8 Claims, 7 Drawing Sheets

CARRIAGE FOR HOLDING A SEPARATION ELEMENT AND SEPARATION ELEMENT

Figure 1:
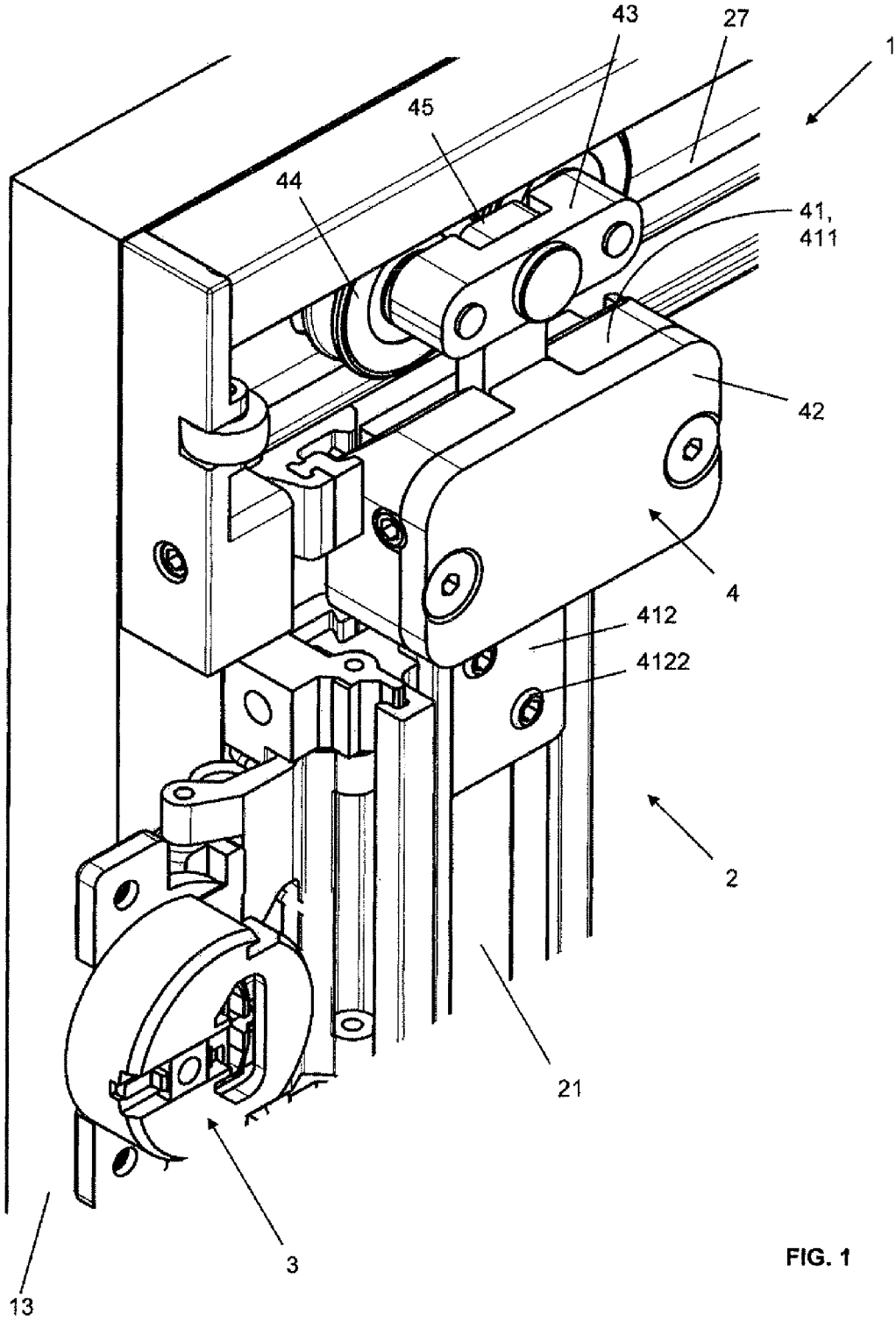

The invention relates to a carriage for holding separation elements and to a separation element provided with such a carriage.

In order to separate or form areas or to close off articles of furniture, glass or wooden panels, doors or blinds are often used.

As a pivotally held separation element causes aesthetic interference in most cases after the article of furniture has been opened, solutions have been developed which allow the separation element, after the article of furniture has been opened, to be inserted into an intermediate space provided in the article of furniture, said intermediate space being delimited possibly by an intermediate wall.

[1], U.S. Pat. No. 5,149,180 A, discloses an article of furniture with a displacement device, by means of which a door held pivotally on a bracket can be sunk from a position of use into a door compartment, which comprises at least one side wall. The bracket is held in a vertical position during travel into the door compartment and travel outwards by a scissor assembly, which comprises two crossed beams connected to each other in an articulated way. One of the two crossed beams is held with its upper end on the upper side of the bracket on a scissor assembly bearing so as to be pivotable and with the lower end within the door compartment in a guide device so as to be pivotable and vertically displaceable. The second beam is held with the upper end within the door compartment in anchoring means so as to be pivotable and with the lower end on the lower side of the bracket so as to be pivotable and vertically displaceable. Upon lowering and outward travel of the doors the upper ends of the crossed beams thus remain constantly at the same height while the lower ends are vertically displaced. In an ideal case the pivot points at the ends of the crossed beams constantly form a rectangle. By releasing the scissor assembly bearing from the bracket said bracket can be vertically displaced in order to position the door within the door compartment at the same distance from the upper side and the lower side of the cupboard.

Furthermore an upper and a lower rail are provided in [1], along which the bracket is guided by means of guide plates in order to prevent a rotation and jamming of the scissor assembly.

Particularly if heavy separation elements are used, then the use of guide plates is no longer satisfactory. In this case, preferably a carriage with running wheels is mounted at the upper end of the bracket, which running wheels are guided on a running rail. The weight of the separation element is thus carried by the carriage, while the remaining torque is absorbed by the substantially unloaded scissor assembly.

In this case too, the correct setting of the height of the bracket held by the carriage is essential. The optimal functioning of the displacement device is indeed only guaranteed if all elements are tailored to each other without defects. It is therefore in turn of central importance that the height of the bracket can be precisely set in relation to the running rail extending perpendicular thereto with simple measures. Thereby it shall be avoided that the carriage must be released from the bracket and displaced for adjustment purposes, which would make simple and precise adjustment practically impossible.

Also for further devices with separation elements, such as sliding doors, it is often necessary that the height of the separation elements is adjusted. If a sliding door is held by two carriages, which are guided in a rail, it is required that the sliding door is aligned horizontally by adjusting the height at each carriage.

From [2], U.S. Pat. No. 6,418,588B1, it is known that the height of a separation elements can be adjusted by turning a connecting screw stepwise, that comprises a threaded shank, which is inserted into a threaded bore provided in the body of the carriage and that comprises a screw head, which is coupled to a fitting, which is provided at the upper edge of the separation element. However, this device requires considerable space below the carriage body for the access of a tool, with which the connecting screw can be grasped and turned. The separation elements can therefore not be lifted towards to the carriage as closely as desired.

In [3], EP1460225A1, a carriage for a sliding door is disclosed, which comprises a holding body, which is inserted in a suitable recess provided at the upper edge of the sliding door. A rotatable load-bearing pin, which comprises a bevelled wheel at its lower end, is provided in the holding body and can be turned by application of a Philips screwdriver through an aperture in the holding body. In this way sliding door can be vertically displaced with a reference to the suspension means. Also with the solution, sufficient space is required below the carriage for the holding body. Further, the upper edge of the sliding doors must be machine accordingly in order to provide said recess, which involves considerable efforts and may not be possible with various sliding doors, particularly glass doors.

It is thus an object of the present invention to create an improved carriage for separation elements that are slidable along the rail and if appropriate can be rotated, which carriage device shall be adjustable in a simple manner, so that a vertical displacement of the separation elements can easily and precisely be adjusted.

In particular a carriage shall be created, which has a compact structure and which requires little space only, so that the sliding door can maximally be lifted towards the rail.

Further, a slidable and, if appropriate rotatable, separation elements shall be created, which is connected to such a carriage.

This object is achieved with a carriage and within separation elements connected to such a carriage, which have the features defined in claims 1 and 13 respectively. Advantageous embodiments of the invention are defined in further claims.

The carriage, which serves for holding a slidable separation element, comprises a carriage body and at least one running wheel, which is a rolling along a rail when the separation elements is displaced.

According to the invention the carriage body comprises a housing with an interior space, in which a holding unit is provided, which is protruding through an opening out of the housing and which is seated slidable in a direction at least approximately vertically to the running direction of the carriage, and which the holding unit comprises a holding element that interacts within the housing with an adjusting element, that is displaceable in relation to the holding element by means of an adjusting screw, which is held by the carriage body, so that the holding unit is held at a selected position, whereas either the part of the holding unit that is protruding out of the housing is provided with the at least one running wheel and the carriage body is connected to the separation element; or the part of the holding unit that is protruding out of the housing is connected to the separation element and the carriage body is provided with the at least one running wheel.

By the integration of an adjustment device into the carriage body or into a housing provided in the carriage body, an extraordinary compact structure of the carriage is obtained. This carriage allows lifting separation elements, such as sliding doors made of glass or wood, closely up to the rail or even into the rail. Disturbing gaps below the rail, through which wind and noise can pass through, can and thus be avoided. Bezels that cover disturbing gaps are normally not needed. At least bezels with reduced dimensions can be used.

Further, the inventive carriage can be adjusted in a simple manner. Particularly advantageous is thereby, that the required tool can be introduced from the side, so that there is no need to keep space free below the carriage for manipulations by the installer. In preferred embodiments, the carriage can be adjusted from both sides, so that the installer can select a suitable side.

Further important is that the adjustment device provided within the carriage is optimally protected against external influences, so that the carriage operates faultlessly after long periods of operation, also when installed at problematic sites, which are exposed to weather.

In a preferred embodiment, the part of the holding unit, which protrudes out of the housing, is pivotally connected to a support lever, which on both sides holds one wheel axle with a running wheel. By using the rotatable support lever this results in optimal load distribution on both running wheels. Irrespectively of the inclination of the receiving profile relative to the running rail, the carriage thus constantly performs its task optimally. A one-sided loading only of one running wheel, which could lead to early wear, is avoided.

However, if the running wheels are mounted on one or both sides of the carriage body, then the holding unit can advantageously be adapted to the fitting provided on the sliding door. For example it may be possible to provide an opening in the glass plate or wooden plate of the sliding door, with which the holding unit could be coupled.

The holding unit preferably comprises a holding bar, on the upper side of which the support lever is rotatably held by means of a central axle, and on the lower side of which holding bar a holding wedge is provided. The upper wedge face of the holding wedge, which is inclined in relation to the running direction of the carriage, cooperates with the lower wedge face of an adjusting wedge, which can be displaced in relation to the holding wedge by means of an adjusting screw held by the carriage body. With the displacement of the adjusting wedge the holding wedge is thus displaced upwards or downwards. The adjusting screw is typically mounted in the carriage housing parallel to the running direction of the carriage.

Preferably, an adjusting screw provided with a threaded shank is used, which adjusting screw has a screw head at each end, said screw heads being held so as to be rotatable in a bearing opening of the carriage housing but not displaceable. The bearing openings are provided in two sides of the carriage housing lying opposite each other and the adjusting screw thus runs completely through the carriage housing. The threaded shank of the adjusting screw is held in a threaded channel of the adjusting wedge and the latter is thus displaced with each rotation of the adjusting screw along said adjusting screw. Access to the adjusting screw is thus possible from both sides of the carriage housing. An adjustment is in turn possible from both sides of the carriage.

The inventive carriage can be used particularly advantageously in the displacement device described below and for mounting separation elements of any kind, such as sliding doors or sliding shutters.

Figure 2:
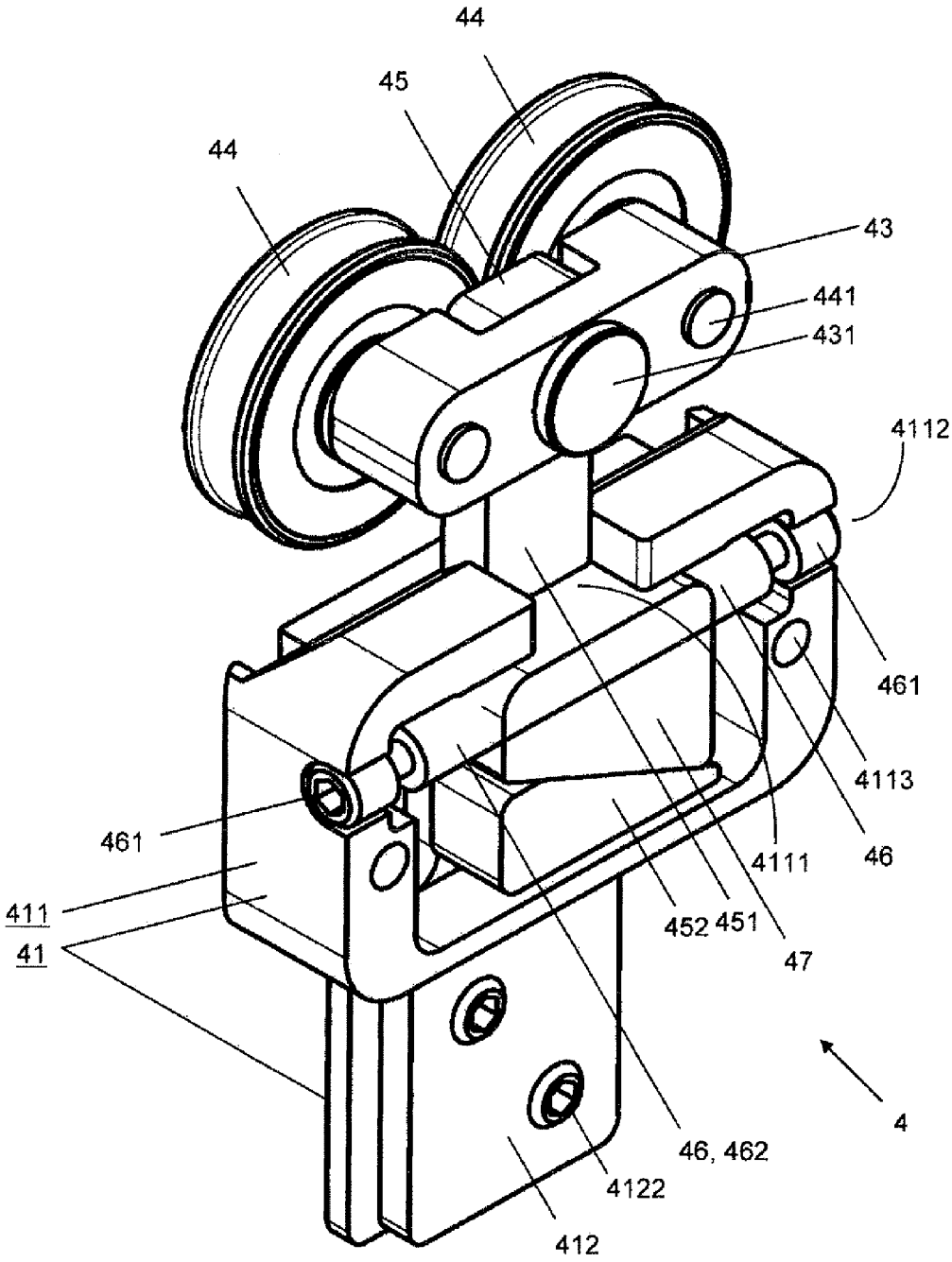
Figure 3:
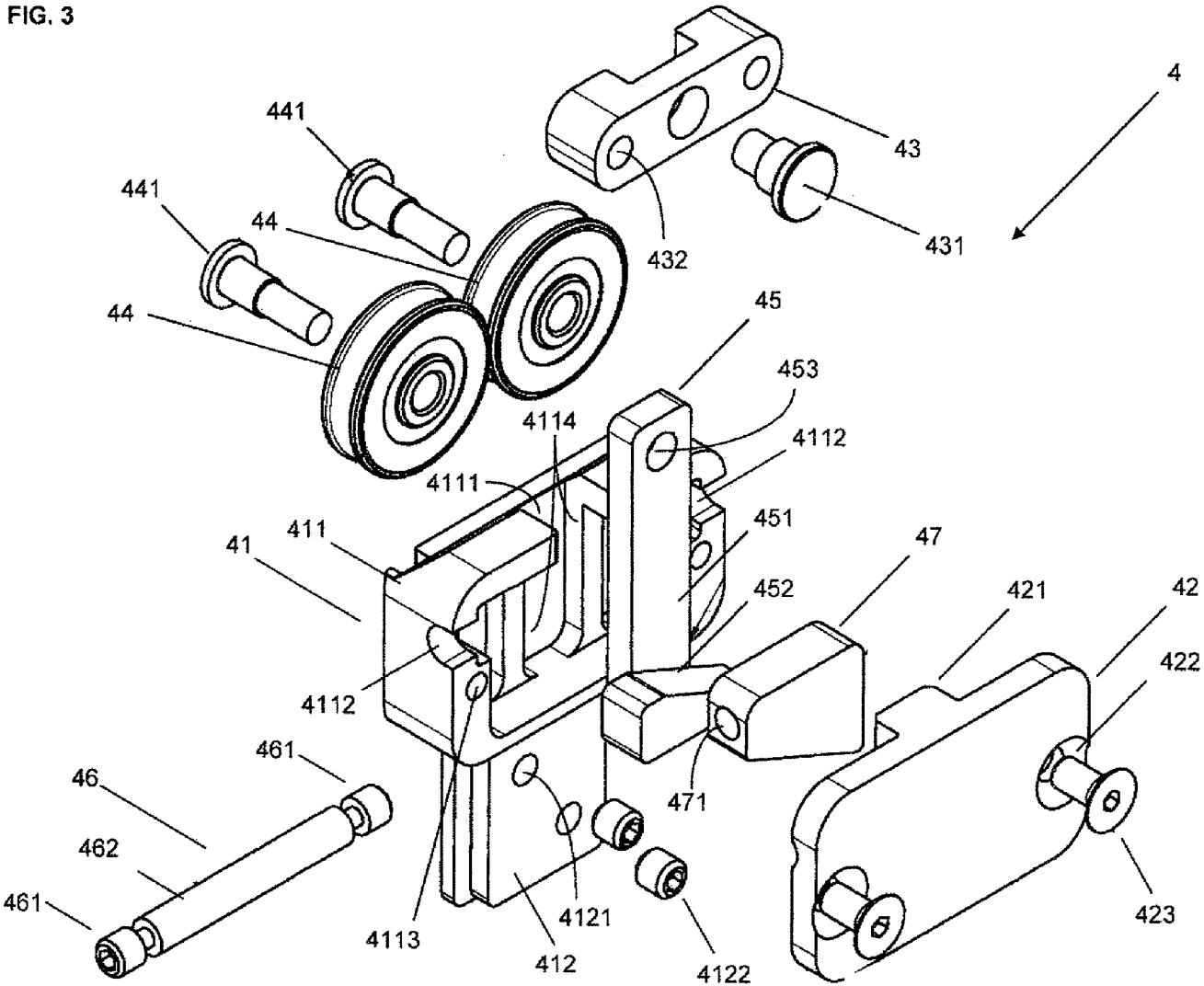
Figure 4:
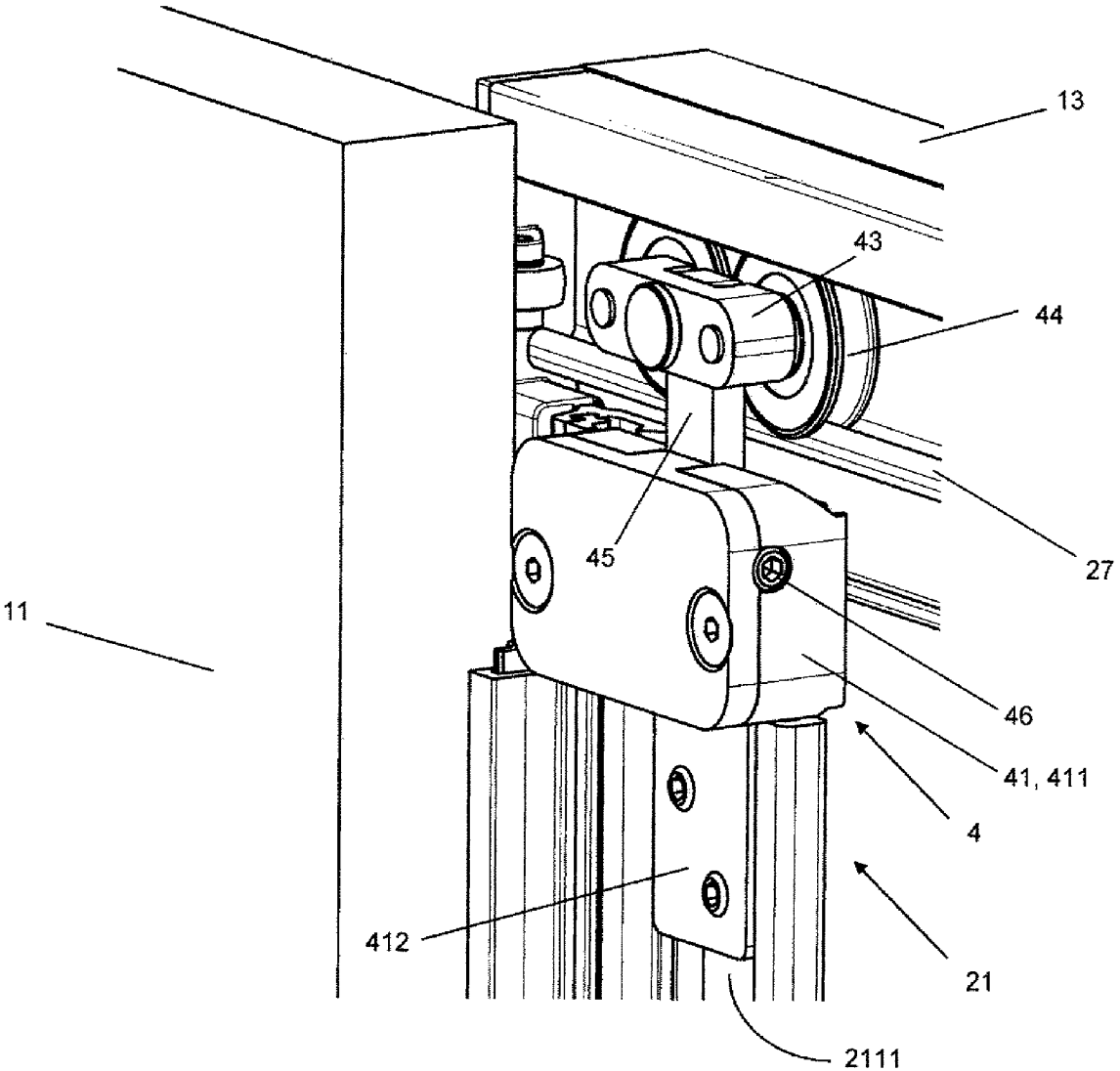
Figure 5:
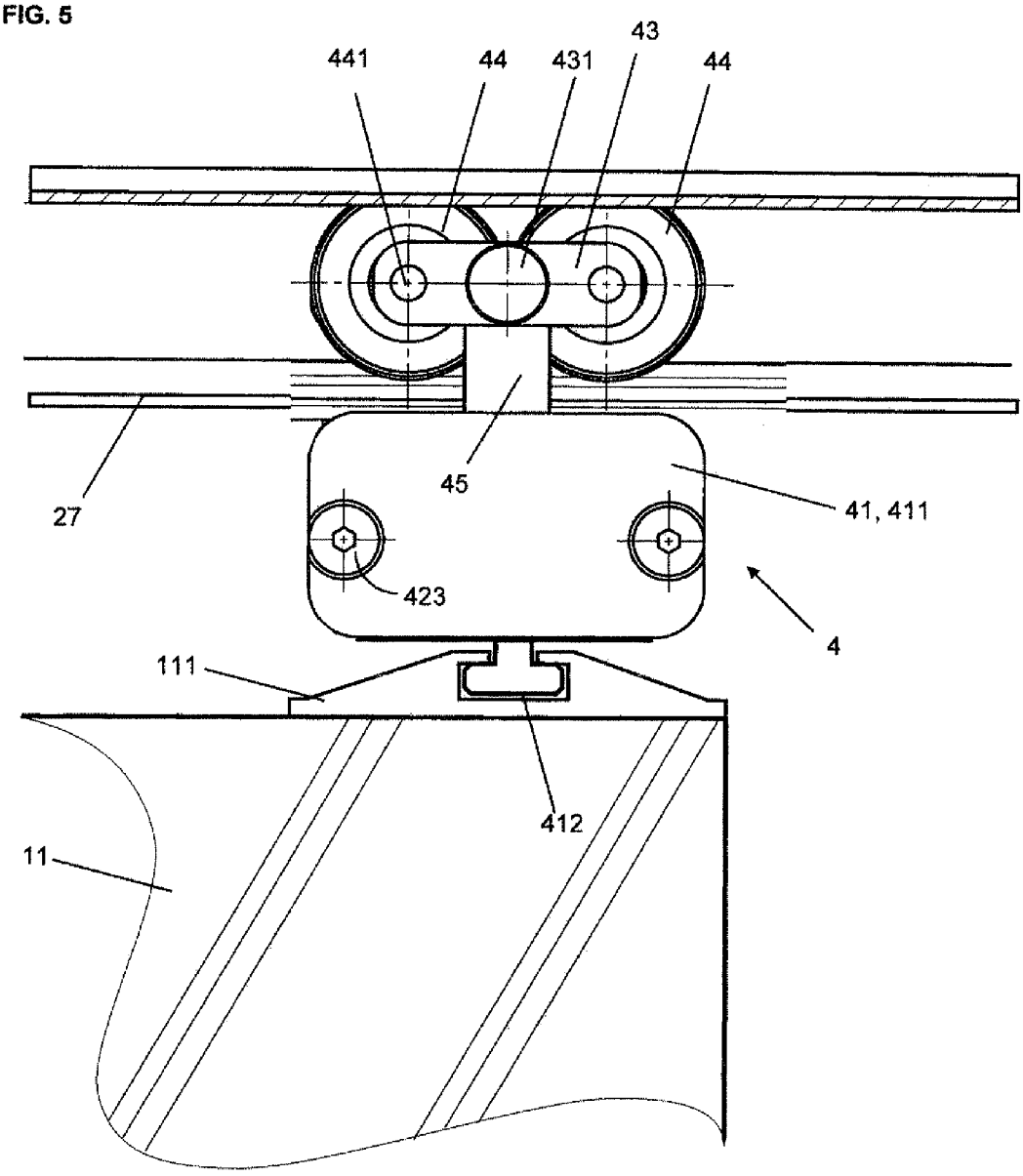
Figure 6:
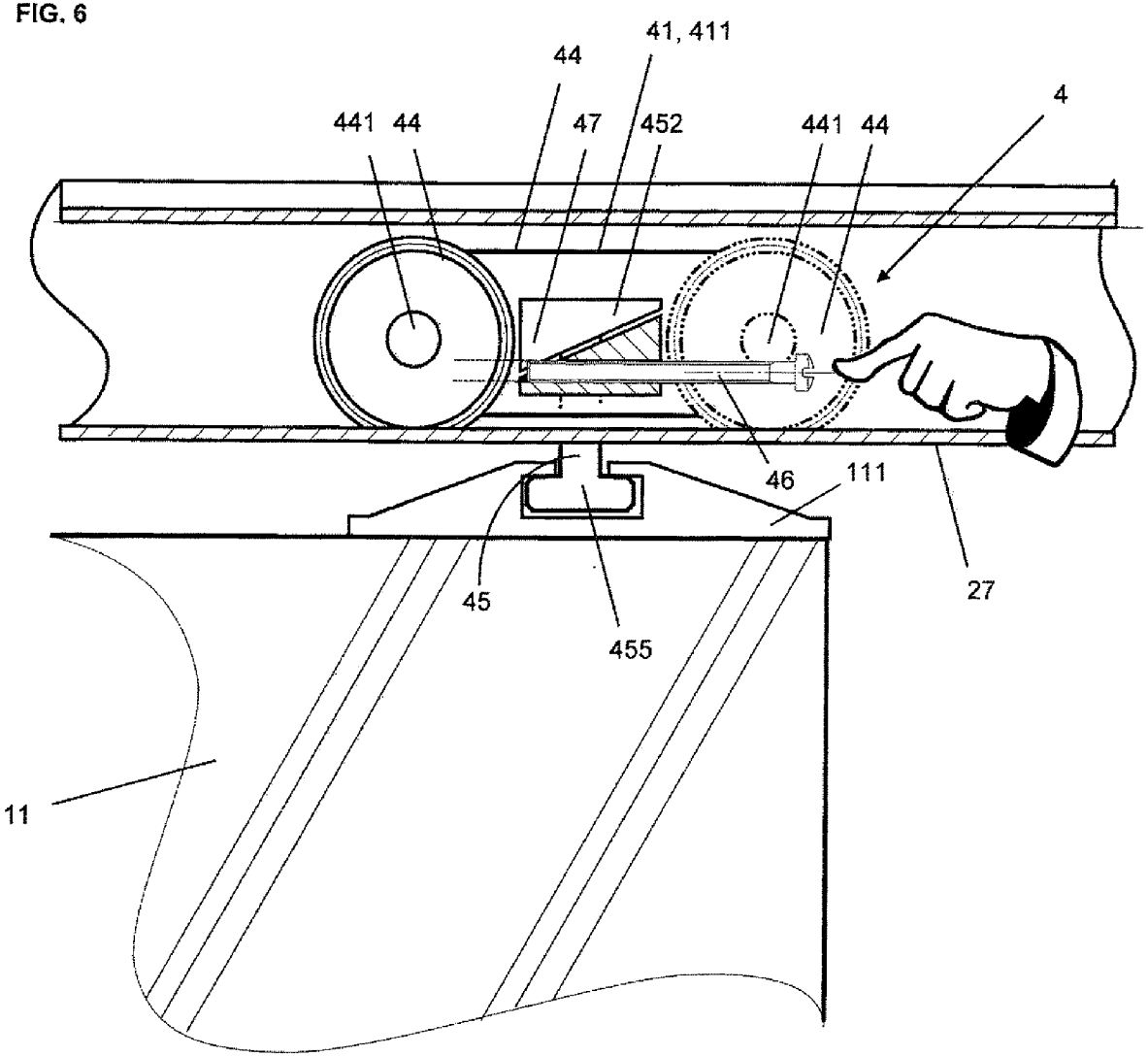

The invention is explained in greater detail below by reference to drawings, in which:

FIG. 1 shows an inventive carriage 4 that is guided along the rail 27 and that comprises a mounting element 412, which is connected to a mounting bracket 21, which, by hinges 3, can be coupled to separation elements, which are slidable or slidable and rotatable;

FIG. 2 the carriage 4 of FIG. 1, which comprises a carriage body 41 with the carriage housing 411 (housing lid 42 removed), in which an adjusting wedge 452, which can be displaced horizontally by means of an adjusting screw 46, acts upon a holding wedge 47, which is coupled with the running wheels 44 by means of the holding unit 45 and a support lever 43;

FIG. 3 the carriage 4 of FIG. 2 in an exploded view;

FIG. 4 the carriage 4 and the bracket 21 of FIG. 1 with a mounted separation element 11 seen from another direction;

FIG. 5 the carriage 4 of FIG. 2 with a mounting part that is connected to a fitting 111 of the separation element 11; and FIG. 6 the carriage 4 of FIG. 2 in a particularly preferred embodiment, in which the holding unit 45 is connected to the fitting 111 on the sliding door 11 and the body 41 of the carriage 4 is provided on one or both sides with wheel axles 441, on which running wheels 44 are held.

FIG. 1 shows a displacement device 2 for an article of furniture 1, which comprises a mounting bracket 21, on which hinges 3 are provided, which serve for holding a separation element 11 (see FIG. 4). The mounting bracket 21 will typically be held in vertical alignment by means of a scissor assembly, as it is disclosed in [1]. The displacement device 2 allows transferring the separation elements 11 into a door compartment 14, which is delimited by an outer sidewall and by an intermediate wall 13 of the article of furniture 1.

The mounting brackets 21 is held by an inventive carriage 4 and guided along an upper rail 27. By this measure the load of the separation elements 11 is absorbed by the carriage 4, and thus reducing the load on the scissor assembly.

The inventive carriage 4, which comprises the carriage body 41 with a carriage housing 411, in which an adjustment device is located, will be described below more closely with reference to FIGS. 1, 2, and 3.

FIG. 2 shows the carriage 4 of FIG. 1 with opened carriage housing 411, in which the elements of the adjustment device 45, 451, 452 as well as 46 and 47 are provided.

FIG. 3 shows the carriage 4 of FIG. 2 in an exploded view.

The carriage 4 comprises a carriage body 41 with a carriage housing 411, in which an holding unit 45 is mounted so as to be displaceable in height. Said holding unit 45 consists of a vertically orientated holding bar 451 and a holding wedge 452 fixed to the lower side of the holding bar 451. On the upper side of the holding bar 451 a bearing opening 453 is provided, into which a central axle 431 can be introduced, which pivotally holds a support lever 43 in the middle. The support lever 43 comprises on each of its two sides a receiving opening 432, in which the axles 441 of running wheels 44 are held. The support lever 43 thus serves as a rocker element, which follows the inclination of the running rail 27 and distributes the load evenly on both running wheels 44.

The holding bar 451 is held in the housing 411 of the carriage body 41 between two guide beams 4114 so as to be vertically displaceable and projects outwards through a housing opening 4111. Between the two guide beams 4114 the holding bar 453 is held by means of a bearing block 421, which is arranged on the lid 42 of the carriage housing 411. On the housing lid 42 receiving openings 422 for end screws 423 are provided, whereby said end screws 423 can be rotated in threaded bores 4113 in the carriage body 41. After the fixing the holding bar 451 is thus held so as to be vertically displaceable.

Furthermore an adjusting screw 46 is provided in the carriage housing 411, which adjusting screw 46 comprises at both ends a screw head 461 and between them a screw shank 462 with a thread. The two screw heads 461 are rotatably held in bearing openings 4112, which are provided in sides of the carriage housing 411 lying opposite each other. The bearing openings 4112 lie at the same height and the adjusting screw 46 is thus orientated horizontally and at the same time perpendicularly to the displacement direction of the holding bar 451.

The screw shank 462 of the adjusting screw 46 is turned into a threaded channel 471, which runs completely through an adjusting wedge 47. The adjusting wedge 47 thereby lies above the holding wedge 452, whereby two wedge faces inclined against the horizontal lie against each other as soon as the holding bar 451 is drawn upwards. Through the rotation of the adjusting screw 46 the adjusting wedge 47 moves in horizontal direction from one side to the other of the carriage housing 411, whereby the holding wedge 452 is displaced downwards or, under load, upwards.

In this way the height of the carriage body 41 and of the bracket 21 connected thereto with the aid of the mounting part 412 can be precisely set. The adjusting screw 46 can be manipulated from two sides of the housing 411 and thus also from the front side of the article of furniture 1. The height is thereby set in such a way that the weight of the separation element 11 is preferably completely assumed by the carriage 4 and the separation element 11 is simultaneously held at the provided height.

FIG. 4 shows the carriage 4 and is the mounting brackets 21 of FIG. 1 with the mounted separation elements 11. The mounting part 412, which is connected to the carriage body 41, has been inserted into a mounting channel 2111 provided in the mounting bracket 21. Separation elements 11, i.e. the door of the article of furniture, is projecting frontally away from the article of furniture, so that it can either be transferred to the door compartment or be turned in order to close the article of furniture.

The inventive carriage 4 with the height adjustment described can also be advantageously used with other devices. It is not thereby compulsory for the holding bar 451 to be connected via a pivotable support lever 43 to the running wheels. The support lever 43 can also be fixedly connected to the holding bar 451.

Furthermore the running wheels 44 or running rollers, which can be provided in any number, can also be directly connected to the carriage body 41, while the holding bar 451 is connected to a separation element 11, for example a sliding door, and can hold this at an optionally adjustable height.

The holding bar 451 can thereby be designed as desired. For example the holding bar can be formed as a thin hook, by means of which the fitting of a separation element 11, e.g. a wooden panel or a glass panel, is detected. Screw connections between the carriage 4 and the fitting 111 of the separation element 11, as described for example in [4], U.S. Pat. No. 6,052,867, can thus be drastically simplified. The fitting connected to the separation element can be reduced in its dimensions to the minimum and no longer requires the mounting of movable parts such as screws.

Nonetheless, it is of course also possible to form the holding bar as a screw, which is preferably rotatably connected to the holding wedge. In this case, with the aid of the rotation of the holding bar or the holding screw, a rough setting can be carried out and, with the aid of the adjusting screw, a fine setting can be carried out. In this case a detent element is preferably provided in the carriage body, for example a locking screw, by means of which the screw-form holding bar can be fixed. For example a vertically extending groove is provided in the holding bar, into which groove the locking screw can be rotated in order to hold it in a rotationally secure way, in which it can be displaced merely vertically.

The inventive carriage 4 can thus be connected in various ways to any desired separation elements 11. The separation elements can be produced from any desired materials such as glass, metal, wood or plastic.

FIG. 5 shows the carriage 4 of FIG. 2 with a mounting part 412 that is connected to a fitting 111 of a sliding door 11.

FIG. 6 shows the carriage 4 of FIG. 2 in a particularly preferred embodiment, in which the holding unit 45 comprises a connecting element 455 that is attached to the fitting 111 of the sliding door 11. The connecting element 455 comprises the form of a screw head, which is coupled with the fitting 111. The body 41 of the carriage 4 is on one side or on both sides provided with wheel axles 441 that hold a running wheel 44 each. Advantageously, the carriage 4, including the adjustment device provided in the carriage housing 411, is completely integrated within the rail 27.

Figure 6A:
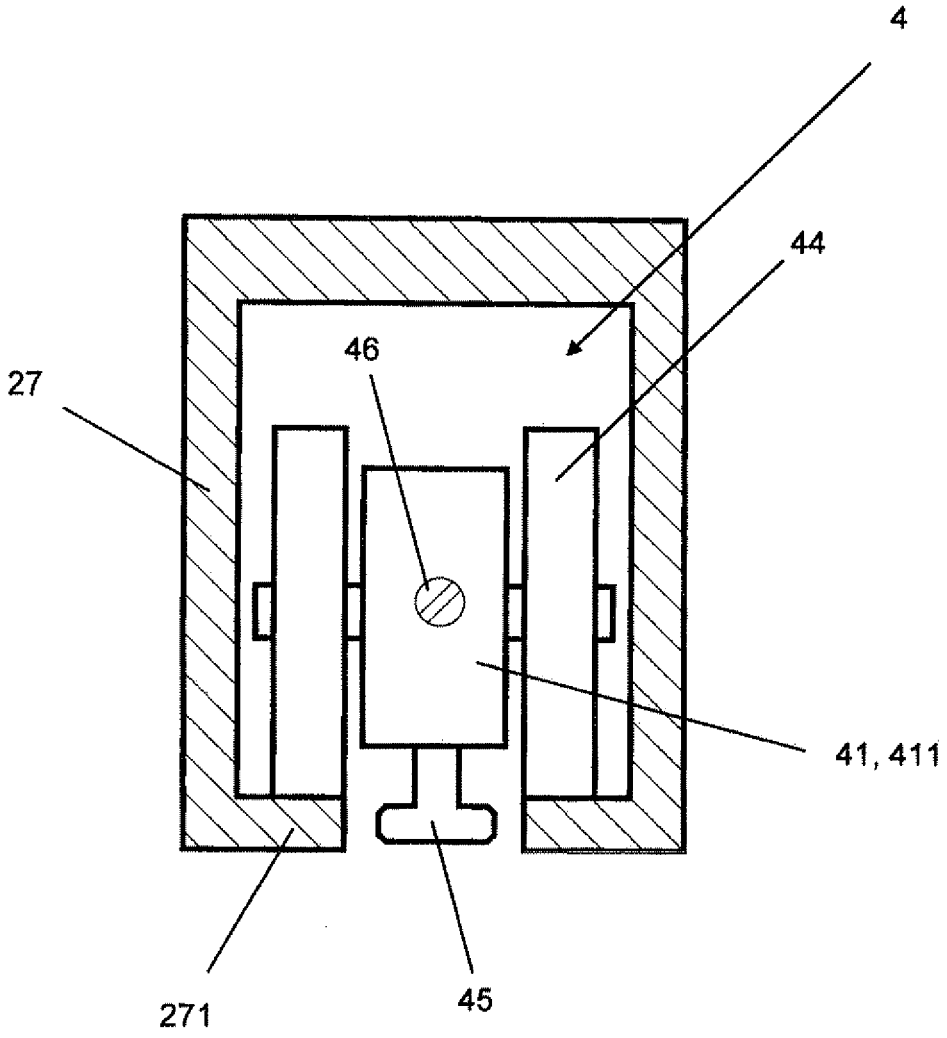

FIG. 6*a* shows that any rail 27 can be used for the inventive carriages 4. For carriages 4 that are provided with running wheels 44 on one side only, normally L-profiled rails 27 are used. For carriages 4 that are provided with running wheels 44 on both sides, normally U-profiled rails 27 are used. The running wheels 44 rolling on foot elements 271 of the rail 27.

As shown in FIGS. 4, 5, and 6, the inventive carriage 4 can be used in various ways. Hence, it is pointed to the fact, that various further embodiments can the result by reversal of functions, such as kinematic reversal.

REFERENCES

[1] U.S. Pat. No. 5,149,180 A
[2] U.S. Pat. No. 6,418,588 B1
[3] EP 1 460 225 A1
[4] U.S. Pat. No. 6,052,867

The invention claimed is:

1. A carriage for holding a slidable separation element comprising:

a carriage body; and at least one running wheel which rolls along a rail when the slidable separation element is displaced;

wherein the carriage body includes a housing with an interior space, in which a holding unit is provided, a part of the holding unit protrudes through an opening out of the housing and is seated slidable in a direction at least approximately vertically to a running direction of the carriage, the holding unit includes a holding element that interacts within the housing with an adjusting element, that is displaceable in relation to the holding element by means of an adjusting screw, which is held by the carriage body, so that the holding unit is held at a selected position, the part of the holding element that protrudes out of the housing is provided with the at least one running wheel, the carriage body is connected to the slidable separation element, the holding element is a holding wedge provided with a wedge face, which is inclined in relation to the running direction of the carriage, and the adjusting element is an adjusting wedge provided with a wedge face, which abuts against the wedge face of the holding element, the adjusting screw is aligned in parallel to the running direction of the carriage and is seated rotatable and non-relocatable in bearing openings of the carriage body, the adjusting screw corn rises a threaded shank with a respective screw head at each end, the screw heads are seated in respective bearing openings, which are arranged in sides, lying opposite each other, of the housing, and the threaded shank is rotatably held in a threaded channel of the adjusting wedge.

2. The carriage according to claim 1, wherein the bearing openings are leading through the walls of the housing, so that each screw head can is configured to be coupled with a tool.

3. The carriage according to claim 1, wherein the holding unit includes a holding bar, which is slidably held within the housing between guide beams.

4. The carriage according to claim 3, wherein the interior space of the housing is closed by a housing lid that includes a bearing block which secures the holding bar between the guide beams.

5. The carriage according to claim 1, wherein the part of the holding unit that protrudes out of the housing is connected via a central axle with a support lever, and on each side includes a wheel axle with a wheel.

6. The carriage according to claim 5, wherein the carriage body includes a mounting part configured to be connected to a mounting bracket, that holds hinges that are connected to the slidable separation element.

7. The carriage according to claim 5, wherein the carriage body includes a mounting part configured to be connected to the slidable separation element or a fitting mounted thereto.

8. The separation element connected to the carriage according to claim 1, wherein the carriage is guided in the rail.

* * * * *